US006402597B1

(12) United States Patent
Sakurai et al.

(10) Patent No.: US 6,402,597 B1
(45) Date of Patent: Jun. 11, 2002

(54) POLISHING APPARATUS AND METHOD

(75) Inventors: Kunihiko Sakurai, Yokohama; Seiji Katsuoka, Atsugi, both of (JP)

(73) Assignee: Ebara Corporation, Tokyo (JP)

( * ) Notice: Subject to any disclaimer, the term of this patent is extended or adjusted under 35 U.S.C. 154(b) by 29 days.

(21) Appl. No.: 09/580,829

(22) Filed: May 30, 2000

(30) Foreign Application Priority Data

May 31, 1999 (JP) ..... 11-151881

(51) Int. Cl.[7] ..... B34B 53/00
(52) U.S. Cl. ..... 451/56; 451/53
(58) Field of Search ..... 451/53, 41, 56, 451/285, 287, 288, 7

(56) References Cited

U.S. PATENT DOCUMENTS 5,749,772 A * 5/1998 Shimokawa ..... 451/53

FOREIGN PATENT DOCUMENTS

JP 11-42551 2/1999
JP 11-347935 12/1999

* cited by examiner

*Primary Examiner*—Derris H. Banks
(74) *Attorney, Agent, or Firm*—Wenderoth, Lind & Ponack, L.L.P.

(57) ABSTRACT

A workpiece such as a semiconductor wafer is polished to a planar finish by a polishing apparatus. The polishing apparatus comprises a turntable having a polishing surface thereon, a top ring for holding a workpiece and pressing the workpiece against the polishing surface, a dressing apparatus having a dresser element for dressing the polishing surface by bringing the dresser element into contact with the polishing surface, and a temperature control device for controlling the temperature of the dresser element before dressing and/or during dressing.

25 Claims, 4 Drawing Sheets

POLISHING APPARATUS AND METHOD

BACKGROUND OF THE INVENTION

1. Field of the Invention

The present invention relates to a polishing apparatus and method, and more particularly to a polishing apparatus and method for polishing a workpiece such as a semiconductor wafer to a flat finish by bringing a surface of the workpiece into contact with a polishing surface on a turntable.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. Though the photolithographic process can form interconnections that are at most 0.5 $\mu$m wide, it requires that surfaces on which pattern images are to be focused by a stepper be as flat as possible because the depth of focus of the optical system is relatively small.

It is therefore necessary to make the surfaces of semiconductor wafers flat for photolithography. One customary way of flattening the surfaces of semiconductor wafers is to polish them with a polishing apparatus, and such a process is called Chemical Mechanical Polishing (CMP) in which the semiconductor wafers are chemically and mechanically polished while supplying a polishing liquid containing certain components and comprising abrasive particles and a chemical solution such as an alkaline solution.

In the polishing apparatus for polishing a surface of a semiconductor wafer, especially a device pattern on the upper surface of a semiconductor wafer, to a flat finish, as a polishing cloth attached to a turntable, a polishing cloth made of a nonwoven fabric or polyurethane foam is employed. Further, an impregnated pad, in which abrasive particles are impregnated into a pad, is also used.

After the semiconductor wafer is contacted with the polishing cloth and polished by rotating the turntable and the top ring which holds the semiconductor wafer, the polishing capability of the polishing cloth is deteriorated due to a deposit of abrasive particles and ground-off particles of the semiconductor material, and due to change in the characteristics of the polishing cloth. Therefore, if the same polishing cloth is used to repeatedly polish semiconductor wafers, the polishing rate of the polishing apparatus is lowered, and the polished semiconductor wafers tend to suffer polishing irregularities. Therefore, it has been customary to condition the polishing cloth according to a process called "dressing" for recovering the surface of the polishing cloth before, or after, or during polishing.

In the dressing process, a dresser element comprising a dresser plate to which diamond particles are attached by electrodeposition is brought into contact with the polishing cloth and rubs the polishing cloth between the polishing processes.

However, in the above conventional method, the polishing rate is lowered immediately after dressing of the polishing cloth is conducted, and hence the polishing condition is unstable. During polishing, the polishing cloth is kept at a certain temperature higher than room temperature due to heat balance between generation of heat caused by friction between the semiconductor wafer and the polishing cloth, and cooling effect caused by the polishing liquid. However, it is considered that after dressing, as shown in FIG. 6, the temperature of the polishing cloth is lowered to substantially the same temperature as the dresser element, and hence it takes time until the temperature of the polishing cloth increases by performing a polishing operation and reaches a steady state. In FIG. 6, the horizontal axis represents the time and the vertical axis represents the temperature of the polishing cloth.

Specifically, when dressing is performed by the conventional dressing apparatus, the heating value Qd is small because the pressing force in the dressing process is smaller than that in the polishing process. Therefore, as shown in FIG. 7, the temperature of the polishing surface is lowered from t1 to t2 due to heat conduction between the polishing cloth and the dresser element which is kept at a temperature in the polishing apparatus or room temperature (normal temperature) in a clean room (or a room in which the polishing apparatus is installed). Therefore, while the workpiece (semiconductor wafer) is being polished after the dressing process, the temperature of the polishing surface increases gradually and reaches the steady state again. In this manner, in the conventional method, the temperature of the polishing surface cannot be kept constant during polishing. Particularly, in the chemical mechanical polishing process in which chemical reaction is caused on a polished surface of the workpiece (semiconductor wafer) by utilizing a chemical solution such as an alkali solution in the polishing liquid, the reaction rate is changed as the temperature is changed. As a result, the polishing rate is greatly changed, and control of thickness of the polished layer (or film) becomes difficult.

SUMMARY OF THE INVENTION

It is therefore an object of the present invention to provide a polishing apparatus and method which can polish a workpiece such as a semiconductor wafer to a surface having a high degree of flatness and control a film thickness on the workpiece to a desired value by conducting a polishing process in a stable condition after dressing.

In order to achieve the above object, according to a first aspect of the present invention, there is provided a polishing apparatus for polishing a surface of a workpiece, comprising: a turntable having a polishing surface thereon; a top ring for holding a workpiece and pressing the workpiece against the polishing surface; a dressing apparatus having a dresser element for dressing the polishing surface by bringing the dresser element in contact with the polishing surface; and a temperature control device for controlling the temperature of the dresser element before dressing and/or during dressing.

With the above arrangement, the temperature of the dresser element is controlled by the temperature control device before dressing and/or during dressing so as to be equal to or higher than that of the polishing surface of the polishing tool (turntable) which is in a steady state during polishing. That is, the polishing surface during dressing can be kept at the same temperature as that of the polishing surface during polishing, which is in a steady state. The heat conduction during dressing is similar to normal heat conduction because the heating value is small, and therefore the temperature of the polishing surface can be adjusted by controlling the temperature of the dresser element.

Specifically, conventionally, the polishing surface shows temperature change shown in FIG. 6. However, by employing the dressing apparatus of the present invention, the polishing surface shows temperature change shown in FIG. 5, and hence the workpiece can be polished at a constant temperature at all times. Therefore, the reaction rate in the polishing process can be kept constant, and polishing of the workpiece can be conducted in a stable condition.

Further, by controlling the temperature of the dresser element, the dressing process can be stabilized, and the polishing surface can be better conditioned.

The temperature control of the dresser element may be conducted before dressing and/or during dressing. Further, the temperature control may be conducted in a feedback control loop while detecting the temperature of the dresser element. The temperature control by the temperature control device is not limited to heating, and may include cooling. For example, if polishing of the workpiece is performed at a temperature equal to or lower than the temperature in the polishing apparatus, then the temperature of the dresser element is controlled so as to be substantially equal to the temperature of the polishing surface. The polishing surface may comprise a polishing cloth, or an abrading plate (fixed abrasive plate).

According to a second aspect of the present invention, there is provided a polishing method for polishing a surface of a workpiece, comprising: polishing a workpiece by bringing a workpiece in contact with a polishing surface on a turntable; dressing the polishing surface by bringing a dresser element of a dressing apparatus in contact with the polishing surface; and controlling the temperature of the dresser element by a temperature control device before dressing and/or during dressing.

According to a third aspect of the present invention, there is provided a dressing apparatus for dressing a polishing surface on a turntable, comprising: a dresser element for dressing a polishing surface by bringing the dresser element in contact with the polishing surface; and a temperature control device for controlling the temperature of the dresser element before dressing and/or during dressing.

In a preferred aspect, the temperature of the polishing cloth is detected directly or indirectly, and the temperature of the dresser element is controlled on the basis of the detected temperature of the polishing cloth.

In this case, a remote sensor such as a thermocouple thermometer or a radiation thermometer is used to detect the temperature of the polishing surface directly. In order to detect the temperature of the polishing surface indirectly, in an example, the relationship between the torque of the turntable motor for rotating the turntable and the temperature of the polishing cloth is found in advance, and the temperature of the polishing surface during polishing may be estimated by detecting the torque of the turntable motor and utilizing the above predetermined relationship.

In a preferred aspect, the temperature of the dresser element is controlled so that the temperature of the dresser element is substantially equal to the temperature of the polishing surface, which is in a steady state, during polishing.

The above and other objects, features, and advantages of the present invention will become apparent from the following description when taken in conjunction with the accompanying drawings, which illustrate preferred embodiments of the present invention by way of example.

DETAILED DESCRIPTION OF THE PREFERRED EMBODIMENTS

Figure 1:
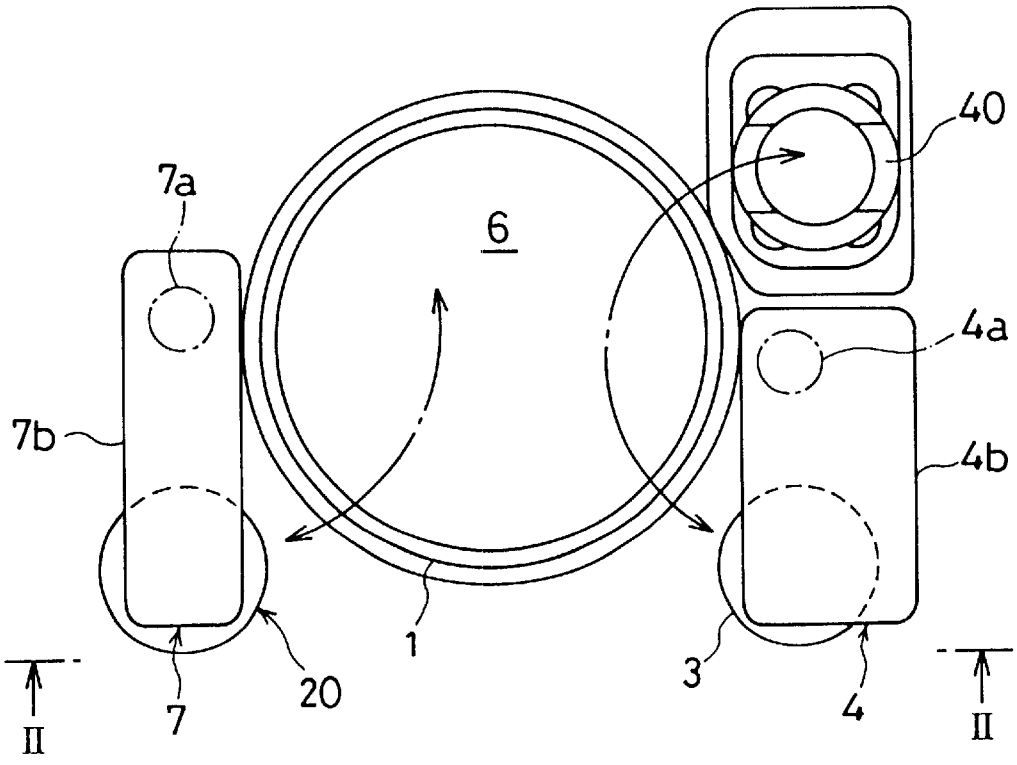
FIG. 1 is a plan view of a polishing apparatus according to an embodiment of the present invention.
Figure 2:
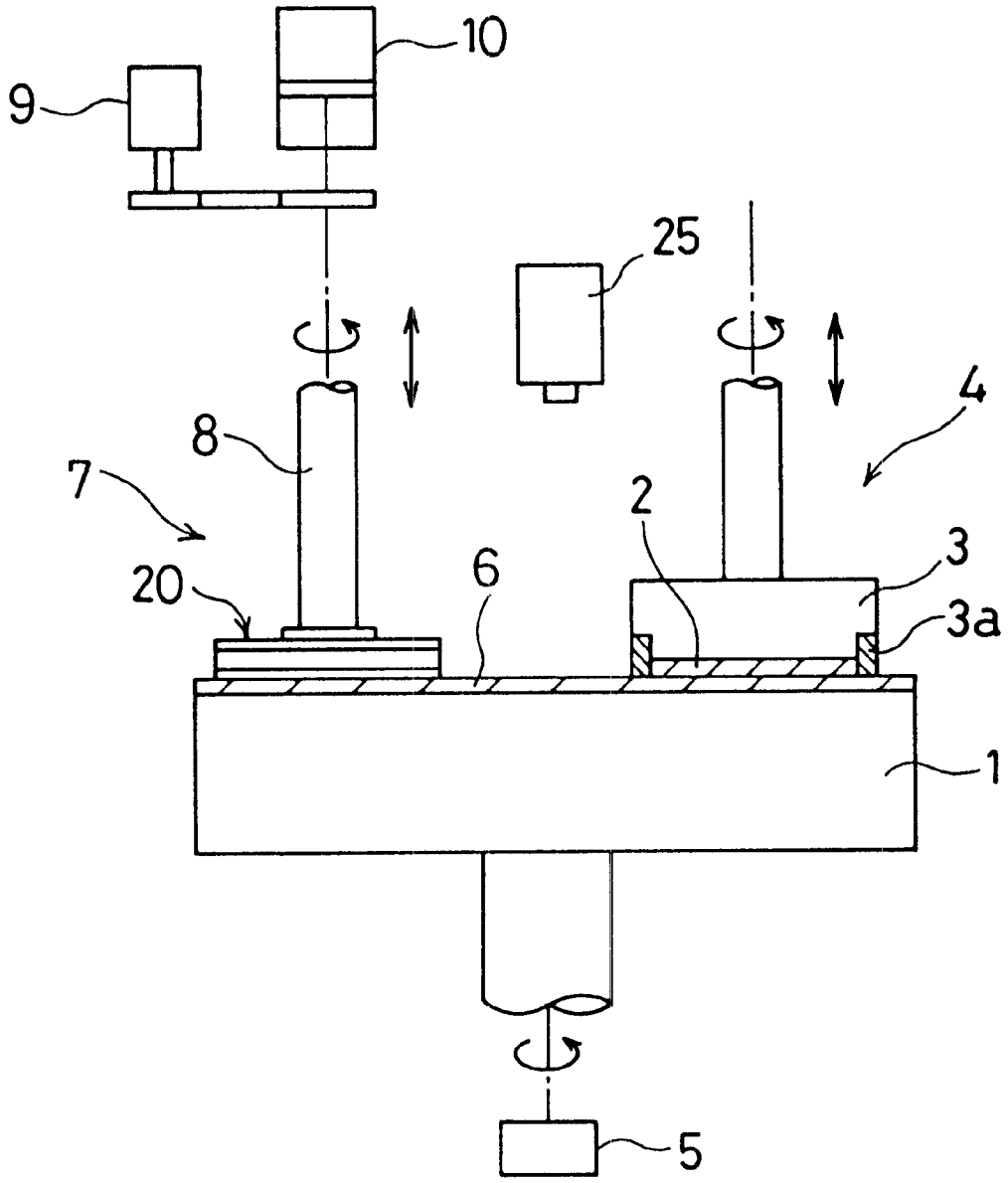
FIG. 2 is an elevational view, partly in cross-section, taken along line II—II of FIG. 1.

Next, a polishing apparatus and method according to the present invention will be described below with reference to the drawings. FIGS. 1 and 2 are views showing a whole structure of the polishing apparatus according to the present invention. Specifically, FIG. 1 is a plan view showing a top ring apparatus and a dressing apparatus which are located in respective positions where they are not in operation. FIG. 2 is a view taken along line II—II of FIG. 1, and shows the top ring apparatus and the dressing apparatus which are located at respective positions where they are in operation. It is not necessary that the top ring apparatus and the dressing apparatus are simultaneously located at the operational positions, and a dressing operation is usually performed at a certain time between polishing processes.

As shown in FIGS. 1 and 2, a polishing apparatus according to the present invention comprises a turntable 1 and a top ring apparatus 4 having a top ring 3 for holding a semiconductor wafer 2 to be polished and pressing the semiconductor wafer 2 against the turntable 1. The turntable 1 is coupled through a vertical shaft to a motor 5, and rotatable about the vertical shaft. A polishing cloth (polishing tool) 6, such as IC-1000 manufactured by Rodel, Inc., is attached to the upper surface of the turntable 1. Instead of the polishing cloth, an abrading plate (polishing tool) comprising abrasive particles such as $CeO_2$ or $SiO_2$ and a binder such as polyimide for binding the abrasive particles may be used. The abrading plate is also called a fixed abrasive plate. The upper surface of the polishing cloth 6 or the upper surface of the abrading plate constitutes a polishing surface.

A pusher 40 is positioned on one side of the turntable 1 adjacent to the top ring apparatus 4. The top ring apparatus 4 is angularly movable in a horizontal plane to move the top ring 3 between a transfer position above the pusher 40 where the semiconductor wafer 2 is transferred to and from the pusher 40, a polishing position over the turntable 1, and a standby position off the turntable 1. The top ring 3 is coupled to a motor and a lifting/lowering cylinder (not shown). The top ring 3 is vertically movable by the lifting/lowering cylinder and is also rotatable about its own axis by the motor as indicated by the arrows (see FIG. 2). When the top ring 3 is lowered toward the turntable 1, the top ring 3 presses the semiconductor wafer 2 against the polishing cloth 6 on the turntable 1 under a given pressure.

The top ring 3 has a holding mechanism (not shown) for holding the semiconductor wafer 2 by its lower surface under vacuum. A guide ring 3*a* is mounted on a lower outer circumferential portion of the top ring 3, whereby the semiconductor wafer 2 is retained against removal from the lower surface of the top ring 3. A polishing liquid containing abrasive particles is supplied to the polishing cloth 6 on the turntable 1 by a polishing liquid supply nozzle (not shown) which is positioned above the turntable 1.

The polishing apparatus also has a dressing apparatus 7 having a dresser 20. The dressing apparatus 7, which is positioned diametrically opposite to the top ring apparatus 4 and the pusher 40 across the turntable 1, is angularly movable in a horizontal plane between a dressing position over the turntable 1 and a standby position off the turntable 1. As shown in FIG. 2, the dresser 20 is connected through a dresser shaft 8 to a motor 9 and a lifting/lowering cylinder 10 which are attached to a dresser arm 7*b*. The dresser 20 is vertically movable by the lifting/lowering cylinder 10 and is also rotatable about its own axis by the motor 9 as indicated by the arrows (see FIG. 2).

Figure 3:
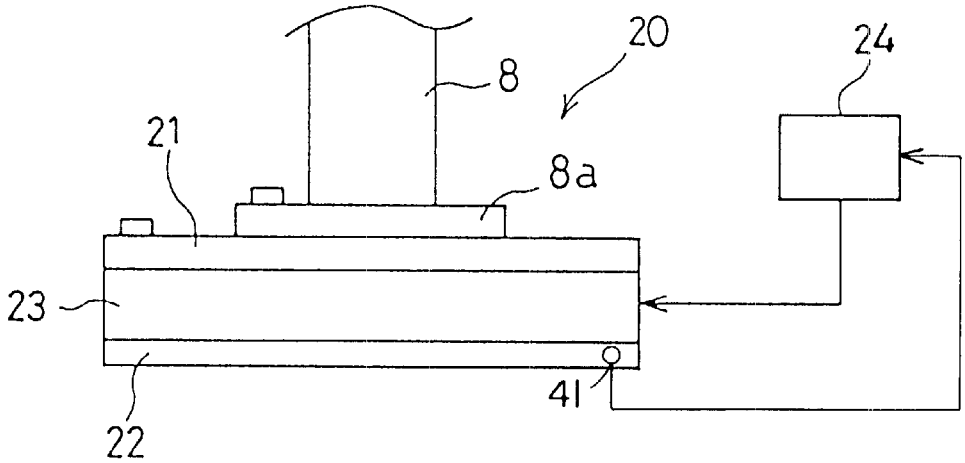
FIG. 3 is a side view of a dressing apparatus according to an embodiment of the present invention.

As shown in FIG. 3, the dresser 20 is attached to an attachment flange 8*a* of the dresser shaft 8. The dresser 20 comprises an upper plate 21, a dresser element 22 comprising a dresser plate having a lower surface to which diamond particles are attached by electrodeposition, and a heater 23 interposed between the upper plate 21 and the dresser element 22. The heater 23 constitutes a temperature control device for controlling the temperature of the dresser element 22. The upper plate 21, the dresser element 22 and the heater 23 are integrally connected to one another by bolts. The heater 23 comprises a ceramic heating resistor or a hot plate, and a heating value of the heater 23 is controlled by a controller 24 such as a CPU (central processing unit) which controls electric current supplied to the heater 23. Further, as shown in FIG. 2, an infrared radiation thermometer 25 as a temperature measuring device is provided above the polishing cloth 6.

Next, a polishing method carried out by the polishing apparatus having the above structure will be described below. During polishing, the dresser 20 is located in the standby position as shown in FIG. 1, and the top ring 3 is located in the polishing position on the turntable 1 as shown in FIG. 2. At this time, the temperature of the polishing cloth 6 in the steady state is measured by the infrared radiation thermometer 25 during polishing, and the measured value is inputted into the controller 24. By controlling electric current supplied to the heater 23, the dresser element 22 is preheated so that the temperature of the dresser element 22 is equal to the measured value. The temperature of the dresser element 22 is controlled on the basis of the predetermined relationship between electric current supplied to the heater 23 and the temperature of the dresser element 22.

After the polishing process is completed, the top ring 3 is angularly moved to the transfer position above the pusher 40, and the dresser 20 is also moved to the dressing position on the turntable 1 and conducts dressing of the polishing surface. The temperature of the dresser element 22 is kept at the same temperature as the polishing cloth 6, and hence dressing of the polishing surface can be performed by the dresser 20 while the temperature of the polishing cloth 6 is kept at substantially the same temperature as in the steady state. Further, during dressing, the dresser element 22 is controlled by the controller 24 so as to have the same temperature as the measured value.

In the above embodiment, the temperature of the dresser element 22 of the dressing apparatus 7 is controlled on the basis of the predetermined relationship between the temperature of the dresser element 22 and electric current of the heater 23. Alternatively, a temperature sensor 41 may be provided on the dresser element 22 or in the vicinity of the dresser element 22 for thereby forming a feedback control loop to control the temperature of the dresser element 22 more accurately. Further, as described above, the dressing operation may be carried out simultaneously with the polishing operation as shown in FIG. 2. In this case, it is desirable that a sensor 41 is provided on the dresser element 22, and electric current supplied to the heater 23 is controlled by the feedback control loop so as to equalize the temperature of the polishing cloth 6 and the temperature of the dresser element 22.

In the above embodiment, the infrared radiation thermometer 25 is provided in the polishing apparatus. If temperature change in the polishing cloth 6 is not so large depending on the environment or polishing condition, as a simpler method, a portable thermometer may be used to measure the temperature of the polishing cloth at a suitable time by an operator, and the measured value is inputted into the controller. Parameters indicative of the temperature of the polishing cloth indirectly may be used to detect the temperature of the polishing cloth indirectly. For example, the torque of the motor 5 for rotating the turntable 1 and the temperature of the polishing cloth 6 are considered to be correlated with each other, and therefore the relationship between the torque and the temperature of the polishing cloth may be found in advance and the temperature of the polishing cloth 6 may be estimated on the basis of the torque measured by a torque measuring device during polishing. Alternatively, the torque of the motor 9 for rotating the dresser 20 may be employed depending on dressing conditions.

Figure 4:
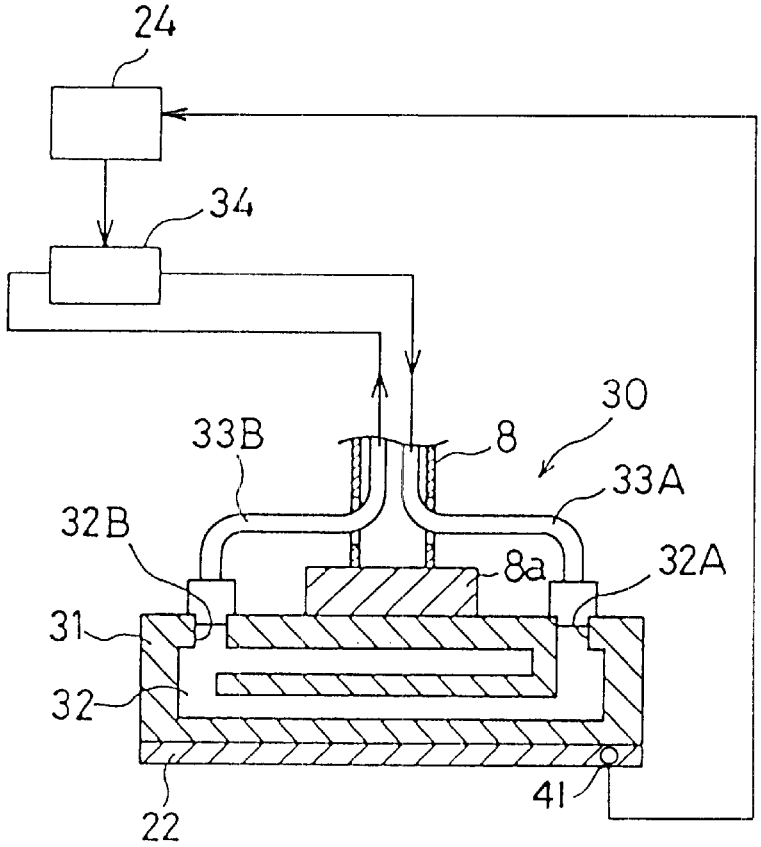
FIG. 4 is a cross-sectional view of a dressing apparatus according to another embodiment of the present invention.
Figure 5:
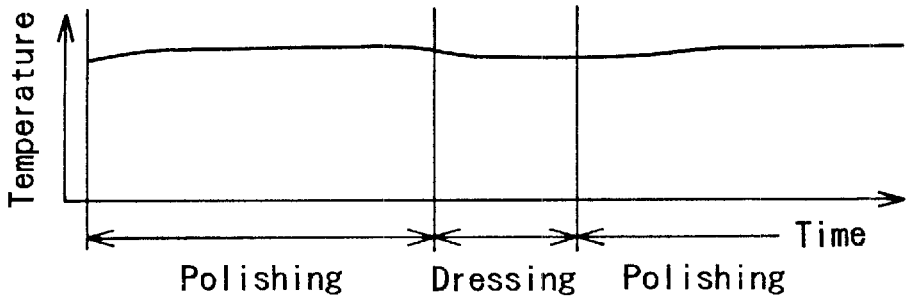
FIG. 5 is a graph showing temperature change of the polishing surface when dressing is conducted by a dressing apparatus according to the present invention.
Figure 6:
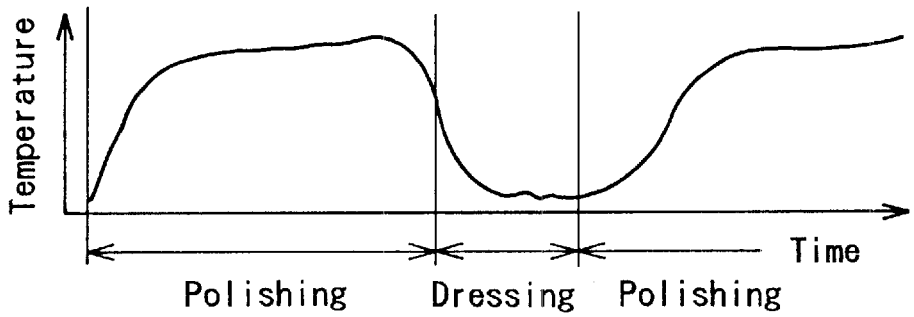
FIG. 6 is a graph showing temperature change of the polishing surface when dressing is conducted by a conventional dressing apparatus.
Figure 7:
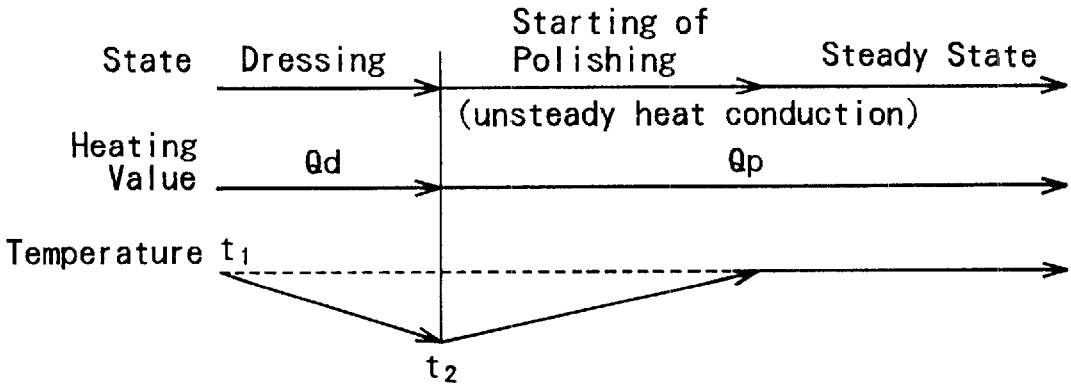
FIG. 7 is a graph showing temperature change of the polishing surface when dressing is conducted by a conventional dressing apparatus.

FIG. 4 is a schematic cross-sectional view showing a dresser according to another embodiment of the present invention. As shown in FIG. 4, a dresser 30 is connected to an attachment flange 8*a* of a hollow dresser shaft 8. The dresser 30 comprises a dresser body 31 and a dresser element 22 attached to the lower surface of the dresser body 31. The dresser body 31 has a flow passage 32 therein, and the flow passage 32 has an inlet 32A and an outlet 32B which communicate with a heat exchanger 34 through pipes 33A and 33B provided in the hollow dresser shaft 8, respectively. The heat exchanger 34, the flow passage 32, and the pipes 33A, 33B jointly constitute a heating medium circulation line.

In the dresser 30, the heat exchanger 34 is controlled by a controller 24 to change the temperature of heating medium such as water supplied to the flow passage 32 in the dresser body 31, thereby controlling the temperature of the polishing cloth 6. By employing the heating medium having a sufficient heat capacity, the temperature of the dresser element 22 can be controlled in a stable state. As with the embodiment of FIG.3, a temperature sensor 41 may be provided on the dresser element 22 for thereby forming a feedback control loop to control the temperature of the dresser element 22 more accurately.

The polishing operation is sometimes conducted while the temperature of the polishing cloth is maintained by cooling the turntable 1 to a temperature in the polishing apparatus or a temperature equal to or lower than room temperature. In the case where the difference between the temperature of the polishing cloth 6 and the temperature in the polishing apparatus is large, a cooling liquid may be supplied to the flow passage 32, and dressing of the polishing cloth may be conducted by the dresser 30 to thus keep the temperature of the polishing cloth 6 constant.

As described above, according to the present invention, by controlling the temperature of the dresser element, the temperature of the polishing cloth during the dressing process can be maintained to be equal to the temperature of the polishing cloth during the polishing process, and hence polishing of the workpiece such as a semiconductor wafer can be conducted at a constant temperature. Therefore, the workpiece can be polished to a surface having a high degree of flatness, with the polished surface having no irregularities.

Although certain preferred embodiments of the present invention have been shown and described in detail, it should be understood that various changes and modifications may be made therein without departing from the scope of the appended claims.

What is claimed is:

1. A polishing apparatus for polishing a surface of a workpiece, comprising:

a polishing surface defined by an abrading plate including abrasive particles and a binder for binding said abrasive particles;

a top ring for holding a workpiece and pressing the workpiece against said polishing surface;

a dressing device including a dresser element, wherein said dressing device is for dressing said polishing surface by bringing said dresser element into contact with said polishing surface; and a temperature control device for controlling a temperature of said dresser element before dressing of said polishing surface and/or during dressing of said polishing surface.

2. The polishing apparatus according to claim 1, wherein said temperature control device comprises a heater provided in said dressing device.

3. The polishing apparatus according to claim 1, wherein said temperature control device comprises a flow passage in said dressing device and a heat exchanger for supplying a heating medium having a controlled temperature to said flow passage.

4. The polishing apparatus according to claim 1, wherein said temperature control device is for controlling the temperature of said dresser element such that the temperature of said dresser element becomes substantially equal to a temperature of said polishing surface when the temperature of said polishing surface is in a stable state during performance of a polishing operation by said polishing surface.

5. A polishing apparatus for polishing a surface of a workpiece, comprising:

a polishing surface;

a top ring for holding a workpiece and pressing the workpiece against said polishing surface;

a dressing device including a dresser element, wherein said dressing device is for dressing said polishing surface by bringing said dresser element into contact with said polishing surface;

a temperature control device for controlling a temperature of said dresser element before dressing of said polishing surface and/or during dressing of said polishing surface; and a sensor for directly detecting a temperature of said polishing surface or indirectly detecting a temperature of said polishing surface, such that said temperature control device controls the temperature of said dresser element via a feedback control loop in response to the temperature of said polishing surface as detected by said sensor.

6. The polishing apparatus according to claim 5, wherein said sensor comprises a radiation thermometer.

7. The polishing apparatus according to claim 5, wherein said temperature control device comprises a heater provided in said dressing device.

8. The polishing apparatus according to claim 5, wherein said temperature control device comprises a flow passage in said dressing device and a heat exchanger for supplying a heating medium having a controlled temperature to said flow passage.

9. The polishing apparatus according to claim 5, wherein said temperature control device is for controlling the temperature of said dresser element such that the temperature of said dresser element becomes substantially equal to a temperature of said polishing surface when the temperature of said polishing surface is in a stable state during performance of a polishing operation by said polishing surface.

10. A polishing apparatus for polishing a surface of a workpiece, comprising:

a polishing surface;

a top ring for holding a workpiece and pressing the workpiece against said polishing surface;

a dressing device including a dresser element, wherein said dressing device is for dressing said polishing surface by bringing said dresser element into contact with said polishing surface;

a temperature control device for controlling a temperature of said dresser element before dressing of said polishing surface and/or during dressing of said polishing surface;

a feedback control loop including a first sensor for detecting a temperature of said dresser element; and a second sensor for directly detecting a temperature of said polishing surface or indirectly detecting a temperature of said polishing surface, such that said temperature control device controls the temperature of said dresser element via said feedback control loop in response to the temperature of said polishing surface as detected by said second sensor and the temperature of said dresser element as detected by said first sensor.

11. The polishing apparatus according to claim 10, wherein said temperature control device comprises a heater provided in said dressing device.

12. The polishing apparatus according to claim 10, wherein said temperature control device comprises a flow passage in said dressing device and a heat exchanger for supplying a heating medium having a controlled temperature to said flow passage.

13. The polishing apparatus according to claim 10, wherein said temperature control device is for controlling the temperature of said dresser element such that the temperature of said dresser element becomes substantially equal to a temperature of said polishing surface when the temperature of said polishing surface is in a stable state during performance of a polishing operation by said polishing surface.

14. A method of operating a polishing apparatus, comprising:

polishing a workpiece by bringing the workpiece into contact with a polishing surface that is defined by an abrading plate including abrasive particles and a binder for binding said abrasive particles;

dressing said polishing surface by causing a dressing device including a dresser element to bring said dresser element into contact with said polishing surface; and using a temperature control device to control a temperature of said dresser element before the dressing of said polishing surface and/or during the dressing of said polishing surface.

15. The method according to claim 14, wherein said temperature control device comprises a heater provided in said dressing device, and using said temperature control device to control the temperature of said dresser element comprises operating said heater.

16. The method according to claim 14, wherein said temperature control device comprises a flow passage in said dressing device and a heat exchanger, and using said temperature control device to control the temperature of said dresser element comprises operating said heat exchanger to heat a fluid medium to a controlled temperature and then flowing said fluid medium at said controlled temperature through said flow passage.

17. The method according to claim 14, wherein using said temperature control device to control the temperature of said dresser element comprises controlling the temperature of said dresser element such that the temperature of said dresser element becomes substantially equal to the temperature of said polishing surface when the temperature of said polishing surface is in a stable state during the polishing of said workpiece.

18. A method of operating a polishing apparatus, comprising:

polishing a workpiece by bringing the workpiece into contact with a polishing surface;

dressing said polishing surface by causing a dressing device including a dresser element to bring said dresser element into contact with said polishing surface; and using a temperature control device to control a temperature of said dresser element before the dressing of said polishing surface and/or during the dressing of said polishing surface, wherein using said temperature control device to control the temperature of said dresser element includes using said temperature control device such that the temperature of said dresser element is controlled via a feedback control loop in response to a temperature of said polishing surface that is detected either directly or indirectly by a sensor.

19. The method according to claim 18, wherein said temperature control device comprises a heater provided in said dressing device, and using said temperature control device to control the temperature of said dresser element comprises operating said heater.

20. The method according to claim 18, wherein said temperature control device comprises a flow passage in said dressing device and a heat exchanger, and using said temperature control device to control the temperature of said dresser element comprises operating said heat exchanger to heat a fluid medium to a controlled temperature and then flowing said fluid medium at said controlled temperature through said flow passage.

21. The method according to claim 18, wherein using said temperature control device to control the temperature of said dresser element comprises controlling the temperature of said dresser element such that the temperature of said dresser element becomes substantially equal to the temperature of said polishing surface when the temperature of said polishing surface is in a stable state during the polishing of said workpiece.

22. A method of operating a polishing apparatus, comprising:

polishing a workpiece by bringing the workpiece into contact with a polishing surface;

dressing said polishing surface by causing a dressing device including a dresser element to bring said dresser element into contact with said polishing surface;

using a first sensor, that forms part of a feedback control loop, to detect a temperature of said dresser element;

using a second sensor to detect a temperature of said polishing surface; and using a temperature control device to control a temperature of said dresser element before the dressing of said polishing surface and/or during the dressing of said polishing surface, wherein using said temperature control device to control the temperature of said dresser element includes using said temperature control device such that the temperature of said dresser element is controlled via said feedback control loop in response to the temperature of said dresser element as detected by said first sensor and the temperature of said polishing surface as detected by said second sensor.

23. The method according to claim 22, wherein said temperature control device comprises a heater provided in said dressing device, and using said temperature control device to control the temperature of said dresser element comprises operating said heater.

24. The method according to claim 22, wherein said temperature control device comprises a flow passage in said dressing device and a heat exchanger, and using said temperature control device to control the temperature of said dresser element comprises operating said heat exchanger to heat a fluid medium to a controlled temperature and then flowing said fluid medium at said controlled temperature through said flow passage.

25. The method according to claim 22, wherein using said temperature control device to control the temperature of said dresser element comprises controlling the temperature of said dresser element such that the temperature of said dresser element becomes substantially equal to the temperature of said polishing surface when the temperature of said polishing surface is in a stable state during the polishing of said workpiece.

* * * * *